US006958475B1

(12) United States Patent
Colby

(10) Patent No.: US 6,958,475 B1
(45) Date of Patent: Oct. 25, 2005

(54) ELECTRON SOURCE

(76) Inventor: Steven M. Colby, P.O. Box 52033, Palo Alto, CA (US) 94303

( * ) Notice: Subject to any disclaimer, the term of this patent is extended or adjusted under 35 U.S.C. 154(b) by 53 days.

(21) Appl. No.: 10/752,194

(22) Filed: Jan. 5, 2004

Related U.S. Application Data

(60) Provisional application No. 60/439,208, filed on Jan. 9, 2003.

(51) Int. Cl.[7] ..... H01J 49/00
(52) U.S. Cl. ..... 250/288; 250/423 F
(58) Field of Search ..... 250/288, 423 F, 250/427, 423 R, 424

(56) References Cited

U.S. PATENT DOCUMENTS

| | | | | |
|---|---|---|---|---|
| 3,943,393 | A | 3/1976 | Naill | |
| 4,459,481 | A | 7/1984 | Todd et al. | |
| 4,649,279 | A | 3/1987 | Delmore | |
| 4,760,306 | A | 7/1988 | Leung et al. | |
| 4,808,820 | A | 2/1989 | Blau | |
| 4,816,685 | A | 3/1989 | Lange | |
| 5,072,147 | A | 12/1991 | Pugh et al. | |
| 5,204,139 | A | 4/1993 | Choi | |
| 5,302,827 | A | 4/1994 | Foley | |
| 5,543,625 | A | 8/1996 | Johnson et al. | |
| 5,561,292 | A | 10/1996 | Buckley et al. | |
| 5,600,136 | A | 2/1997 | Hablanian et al. | |
| 5,717,076 | A | 2/1998 | Yamamoto et al. | |
| 5,726,524 | A | 3/1998 | Debe | |
| 5,727,978 | A | 3/1998 | Alvis et al. | |
| 5,773,834 | A | 6/1998 | Yamamoto | |
| 5,773,921 | A | 6/1998 | Keesmann | |
| 5,864,199 | A | 1/1999 | Alvis et al. | |
| 5,869,626 | A | 2/1999 | Yamamoto et al. | |
| 5,948,465 | A | 9/1999 | Blancher-Fincher et al. | |
| 5,973,444 | A | 10/1999 | Xu et al. | |
| 5,985,232 | A | 11/1999 | Howard et al. | |
| 6,020,677 | A | 2/2000 | Blanchet-Fincher et al. | |
| 6,057,637 | A * | 5/2000 | Zettl et al. | 313/310 |
| 6,062,931 | A | 5/2000 | Chuang et al. | |
| 6,066,019 | A | 5/2000 | Bewlay | |
| 6,087,765 | A | 7/2000 | Coll et al. | |
| 6,097,138 | A | 8/2000 | Nakamoto | |
| 6,181,055 | B1 | 1/2001 | Patterson et al. | |
| 6,217,843 | B1 | 4/2001 | Homyonder et al. | |
| 6,221,154 | B1 | 4/2001 | Lee et al. | |
| 6,231,744 | B1 | 5/2001 | Ying et al. | |

(Continued)

FOREIGN PATENT DOCUMENTS

EP 0913508 A3 12/1999

OTHER PUBLICATIONS

Ron Dagani et al. "Nano Technology, A Special Report," Chemical & Engineering News, Oct. 16, 2000, pp 25-42.
Philip G. Collins et al. "Nanotubes for Electronics," Scientific American, Dec. 2000, pp 62-69.
Ann Thayer "Nanotube Firm Building Pilot Plant," Chemical & Engineering News, Oct. 8, 2001, p 11.
Ron Dagani "Slimming Down Inorganic Tubes," Chemical & Engineering News, Apr. 23, 2001, p 13.

*Primary Examiner*—Kiet T. Nguyen

(57) ABSTRACT

A filament assembly configured for generating electrons and including nanoparticles and/or nanofilaments. The filament assembly is optionally incorporated an analytical systems such as a mass analyzer or x-ray source. The nanoparticles and/or nanofilaments are configured to produce improved electron generation, thermal stability, and/or other properties relative to the prior art. Methods of using the filament assembly are described.

36 Claims, 7 Drawing Sheets

U.S. PATENT DOCUMENTS 6,239,547 B1 5/2001 Uemura et al.
6,250,984 B1 6/2001 Jin et al.
2001/0040215 A1 * 11/2001 Ahmed et al. ..... 250/307
2003/0122085 A1 * 7/2003 Stengl et al. ..... 250/423 F
2004/0151835 A1 * 8/2004 Croci et al. ..... 427/249.1
2004/0155180 A1 * 8/2004 Zubarev ..... 250/281

* cited by examiner

ELECTRON SOURCE

CROSS-REFERENCE TO RELATED APPLICATIONS

This application claims benefit of commonly owned U.S. Provisional Patent Application No. 60/439,208 entitled "Nanofilament Electron Source for Mass Analyzer," filed Jan. 9, 2003. The disclosure of this provisional patent application is incorporated herein by reference.

BACKGROUND OF THE INVENTION

Field of the Invention

The invention is in the field of scientific instrumentation and more specifically in the field of electron generation.

Prior Art

Electron sources are used in a variety of systems. These include, for example, electron guns, electron microscopes, and electron ionization systems. A typical electron source includes a filament, such as a wire or ribbon heated by the passage of a current. These sources include disadvantages such as substantial heating of the filament. In various instances heating limits filament lifetime, causes undesirable reactions with background gasses, results in heating of surroundings and/or causes movement of the filament. All of these results may limit utility of an electron source.

"Field emission" electron sources utilize a fine tip or tips, such as a needle or series of microneedles to produce a very high electric field. As a result of the high field electrons are spontaneously emitted. Unfortunately the wide distribution in electron energies that results from this source makes it unsuitable or inconvenient for many applications. In addition, microneedles typically consist of micro-scale carbon structures having an abundance of reactive sites. The reactive sites result in operational lifetimes or stability periods that are limiting. These carbon structures have an abundance of reactive sites because they are typically poorly ordered structures.

SUMMARY OF THE INVENTION

Various embodiments of the invention include a mass analyzer comprising an electron source, the electron source including an electron filament coupled to an electrical supply, the electron filament including a conductive wire or conductive ribbon, and the electron filament configured to generate electrons when heated, a plurality of nanofilaments disposed on the surface of the electron filament, and a filament body for positioning the electron filament relative to a mass filter.

Various embodiments of the invention include a mass analyzer comprising an electron source, the electron source including an electron filament coupled to an electrical supply configured to pass a current through the electron filament, a plurality of nanofilaments disposed on the surface of the electron filament, and a filament body for positioning the electron filament relative to a mass filter, and means for directing electrons generated using the electron filament.

Various embodiments of the invention include a filament assembly comprising an electron filament coupled to an electrical supply configured to provide a current through the electron filament and to hold the electron filament at a potential relative to part of an electron source, a plurality of nanofilaments disposed on the surface of the electron filament, and means for positioning the electron filament.

Various embodiments of the invention include an analysis system comprising an electron filament coupled to an electrical supply configured to pass a current through the electron filament and to hold the electron filament at a potential of approximately 70 Volts relative to an other part of the analysis system, the electron filament including a conductive wire or conductive ribbon, the electron filament configured to generate electrons when heated, a plurality of nanofilaments disposed on the surface of the electron filament, a filament body for positioning the electron filament relative to the other part of the analysis system, means for directing electrons generated using the electron filament, a mass filter configured to filter ions generated using the generated electrons, and an ion detector configured to detect the filtered ions.

Various embodiments of the invention include a method of analyzing a sample comprising, generating electrons with energy of approximately 70 eV, using an electron filament coupled to an electrical supply configured to pass a current through the electron filament and to hold the electron filament at an approximate potential, the electron filament including a conductive wire or conductive ribbon, the electron filament further including a plurality of nanofilaments disposed on the surface of the electron filament, causing the generated electrons to contact the sample, ionizing the sample using the generated electrons, to produce a ions, separating the produced ions, and detecting the separated ions.

Various embodiments of the invention include a method of analyzing a sample comprising generating electrons using an electron filament coupled to an electrical supply configured to pass a current through the electron filament and to hold the electron filament at an approximate potential, the electron filament including a conductive wire or conductive ribbon, the electron filament further including a plurality of nanofilaments disposed on the surface of the electron filament, causing the generated electrons to contact a ion, fragmenting the ion using the generated electrons, to produce an ion fragment, filtering the produced ion fragment, and detecting the filtered ion fragment.

Various embodiments of the invention include a filament assembly comprising an electron filament configured to be coupled to an electrical supply for providing a current through the electron filament and for holding the electron filament at a potential relative to part of an electron source, and a plurality of nanoparticles disposed within the electron filament.

BRIEF DESCRIPTION OF THE VARIOUS VIEWS OF THE DRAWING

DETAILED DESCRIPTION OF THE INVENTION

The invention includes an electron filament having a coating of nanofilaments. A nanofilament is a nanotube, nanowire or other ordered nanostructure. In a typical embodiment, nanofilaments are on the nanometer size scale. This size allows electron generation at lower temperatures and/or electric fields than microneedles of the prior art. In addition, the ordered structure of a nanofilament gives it a lower chemical reactivity than prior art microneedles and thus advantages in terms of stability, lifetime, operating temperature or the like. Some embodiments of the invention also include filament assemblies, electron source assemblies, mass filters and analytical systems including the electron filament of the invention.

Figure 1:
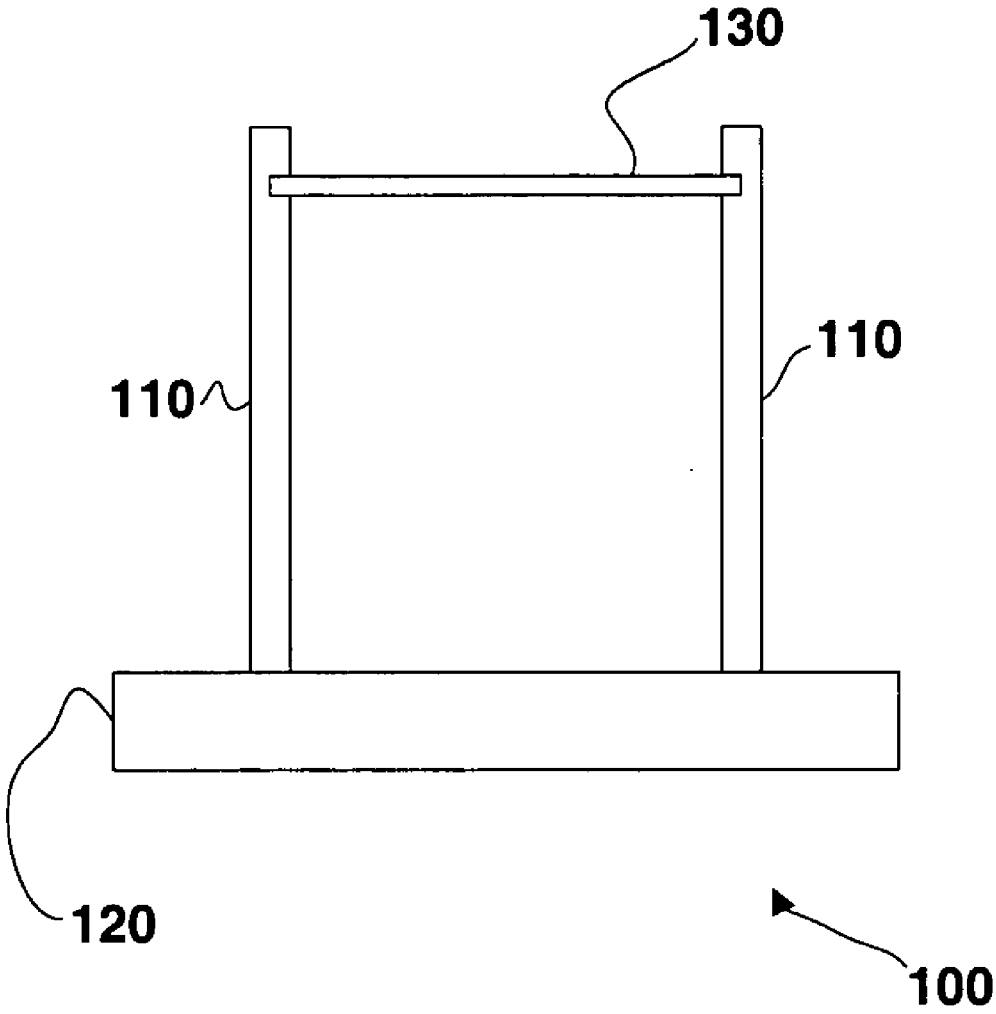
FIG. 1 illustrates a filament assembly, according to various embodiments of the invention.

FIG. 1 illustrates a filament assembly, generally designated 100, according to one embodiment of the invention. This embodiment of filament assembly 100 includes a plurality of support posts 110 mounted in a filament body 120. Support posts 110 are disposed to support an electron filament 130. In operation, electron filament 130 is conductive and current is optionally passed through electron filament 130 in order to raise its temperature. Electron filament 130 is also optionally surrounded by an electric and/or magnetic field configured to guide emitted electrons. In practice, filament assemblies take a wide variety of forms known in the prior art. The invention may be adapted to other geometries without going beyond the intended scope of the invention. For example, electron filament 130 may be a wire, ribbon, or alternative shape. Support posts 110 and filament body 120 may take a variety of shapes and sizes.

Figure 2:
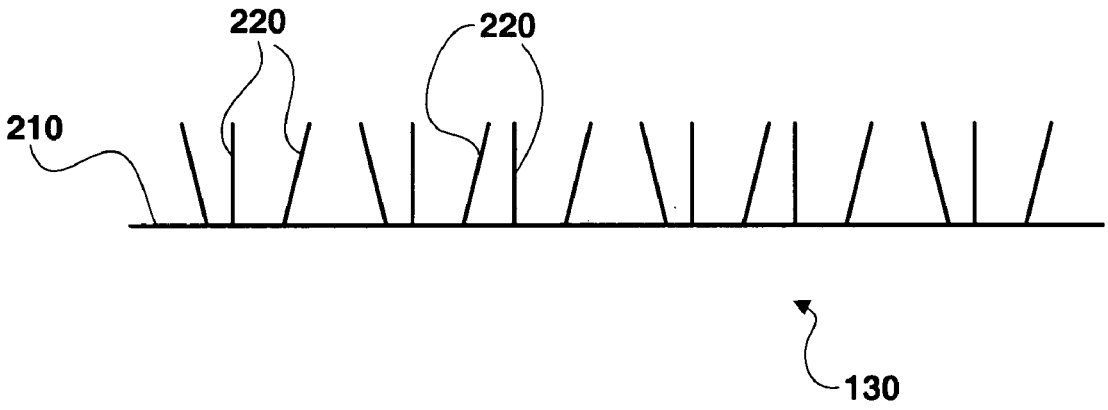
FIG. 2 illustrates an expanded view of a surface of an electron filament showing that the surface is coated with a plurality of nanofilaments, according to various embodiments of the invention.

FIG. 2 illustrates an expanded view of a surface 210 of electron filament 130 showing that surface 210 is coated with a plurality of nanofilaments 220 having ordered structure. Nanofilaments 220 are configured to generate free electrons when filament wire 140 is placed in an electric field and/or when filament wire 140 is heated. In a typical embodiment, a density of nanofilaments 220 on surface 210 is greater than shown in FIG. 2. Nanofilaments 220, within the scope of the invention include carbon nanotubes, nanowires, and the like.

Nanofilaments 220 coated on surface 210 are configured to reduce the heat and/or electric filed required for electron emission from electron filament 130 relative to an uncoated instance of surface 210. As described herein the reduction in temperature and electric field required for electron emission provides unique functionality when coupled with a mass analyzer or other device including an electron source.

Figure 3:
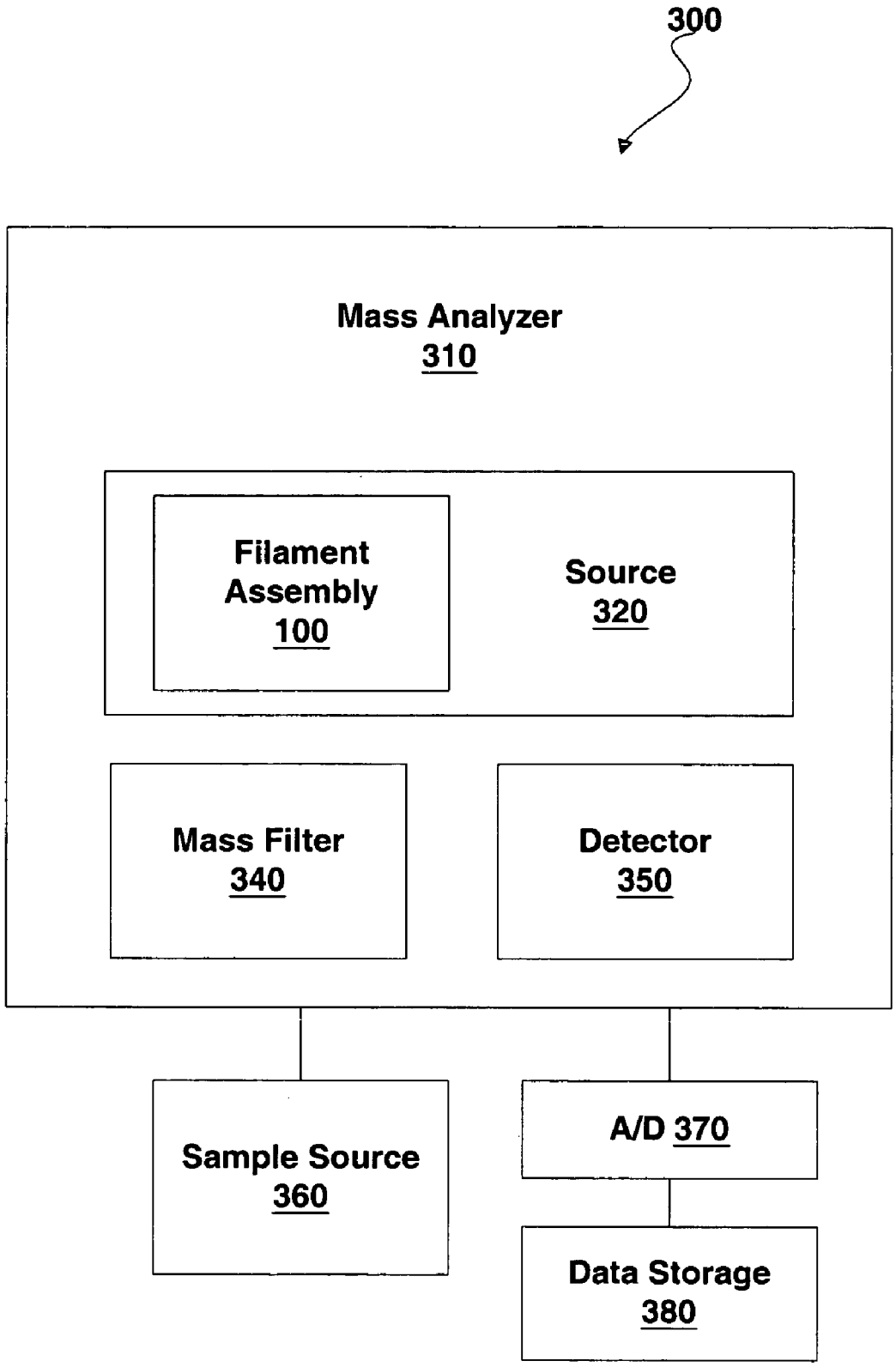
FIG. 3 is a block diagram illustrating a relationship between a filament assembly and an analysis system, according to various embodiments of the invention.

FIG. 3 is a block diagram illustrating a relationship between filament assembly 100 and an analysis system generally designated 300. Analysis system 300 includes a mass analyzer 310, an optional sample source 360, an optional analog to digital converter 370 and an optional data storage 380.

Mass analyzer 310 is a system configured to measure the mass, mass to charge ratio, fragmentation and/or collision cross-section of atoms or molecules. Mass analyzer 310 includes filament assembly 100 which may or may not be considered part of a source 320. Within source 320 neutral atoms or molecules are ionized, with electrons generated using filament assembly 100, to produce negative or positive ions. The ionization processes within source 320 include electron capture ionization, electron impact ionization, chemical ionization, or the like. In an alternative embodiment, ions within source 320 undergo electron capture or fragmentation processes resulting from collisions with electrons generated using filament assembly 100.

Following ionization or fragmentation, the resulting ions are subjected to a mass filter 340 that distinguishes ions as a function of their mass, mass to charge ratio, fragmentation or collision cross-section. A detector 350 is positioned to detect ions after processing by mass filter 340. Signal from detector 350 is optionally coupled to an analog to digital converter 370 and stored in an optional data storage 380, such as a hard disk, compact disk, memory, or the like.

In one embodiment of the invention sample source 360 is a gas chromatograph. In other embodiments sample source 360 is a liquid chromatograph, probe, leak valve, flow system, headspace chamber, pyrolysis system, second mass analyzer or other means of introducing sample to mass analyzer 360.

Filament assembly 100 generates free electrons at temperatures lower than analogous prior art electron sources that do not include nanofilaments 220. In various embodiments the reduction in temperature required to generate free electrons. In these embodiments operating temperatures are less than 1200, 1100, 1000, and 900 degrees Centigrade. As described herein, the lower temperatures have several unanticipated advantages with respect to use of filament 140 in combination with mass analyzer 310. In some embodiments Filament 130 includes Thorium.

For example, in one embodiment the lower temperature requirement results in a lower heating current requirement. A reduced current need is advantageous to systems utilizing a limited power source such as a battery.

In some embodiments electrons are generated at energies of essentially 70 electron volts using filament 140. The energies are typically close enough to 70 eV that resulting data is comparable with 70 eV mass spectrometric data of the prior art. Use of nanofilaments 220 on electron filament 130 may allow generation of electrons closer to 70 eV and/or with a narrower distribution of energies than prior art field emission systems.

In one embodiment the lower temperature requirement results in an extended lifetime of filament 140. By operating at a lower temperature the useful life of the source of free electrons is extended. This reduces, relative to the prior art, the occurrence of filament wires burning out. Reduced burnout frequency increases the useful operating time and reproducibility of analysis system 300. It also reduces the probability that an analysis of a particular sample will be lost through a filament burning out during the analysis.

Extended filament lifetimes of the invention may reduce a need to include more than one filament in analysis system 300. This expands the design possibilities for mass analyzer 310.

In one embodiment the lower temperature requirement results in lower temperature gradients across electron filament 130 and therefore reduced thermal movement of filament 140 relative to the prior art. Reduced movement allows improved positioning and stability of a resulting electron beam. These factors in turn, allow improved performance of analysis system 300 relative to analysis systems in the prior art. In various embodiments, filament 130 moves less than 500 microns, 100 microns, 50 microns, 10 microns, 5 microns, or 2 microns during use.

In one embodiment the lower temperature requirement reduces the number of undesirable reactions between the filament and background gasses. Since the surface temperature of electron filament 130 is lower it is less likely to catalyze reactions. Embodiments of the invention include electron sources having background pressures greater than $1.0\times10^{-7}$ Torr, such as may be found when sample source 360 is a gas or liquid chromatograph. (The background may include sample as well as other gasses.) In other embodiments the background pressure within source 320 is greater than $1.0\times10^{-5}$ , $1.0\times10^{-4}$ , $1.0\times10^{-3}$, $1.0\times10^{-2}$, 0.1 or 1.0 Torr.

In several embodiments the lower temperature requirement reduces the heating of surroundings relative to the prior art. The surroundings may include background gasses or parts of mass analyzer 310. Reduced background gas temperature is important to embodiments of source 320 configured for chemical ionization. Reduced part temperature reduces the catalysis of reactions at part surfaces. Embodiments of the invention include temperatures of source 320 that are lower then 150, 140, 125, 100 or 85 degrees Centigrade in a chemical ionization mode.

Figure 4:
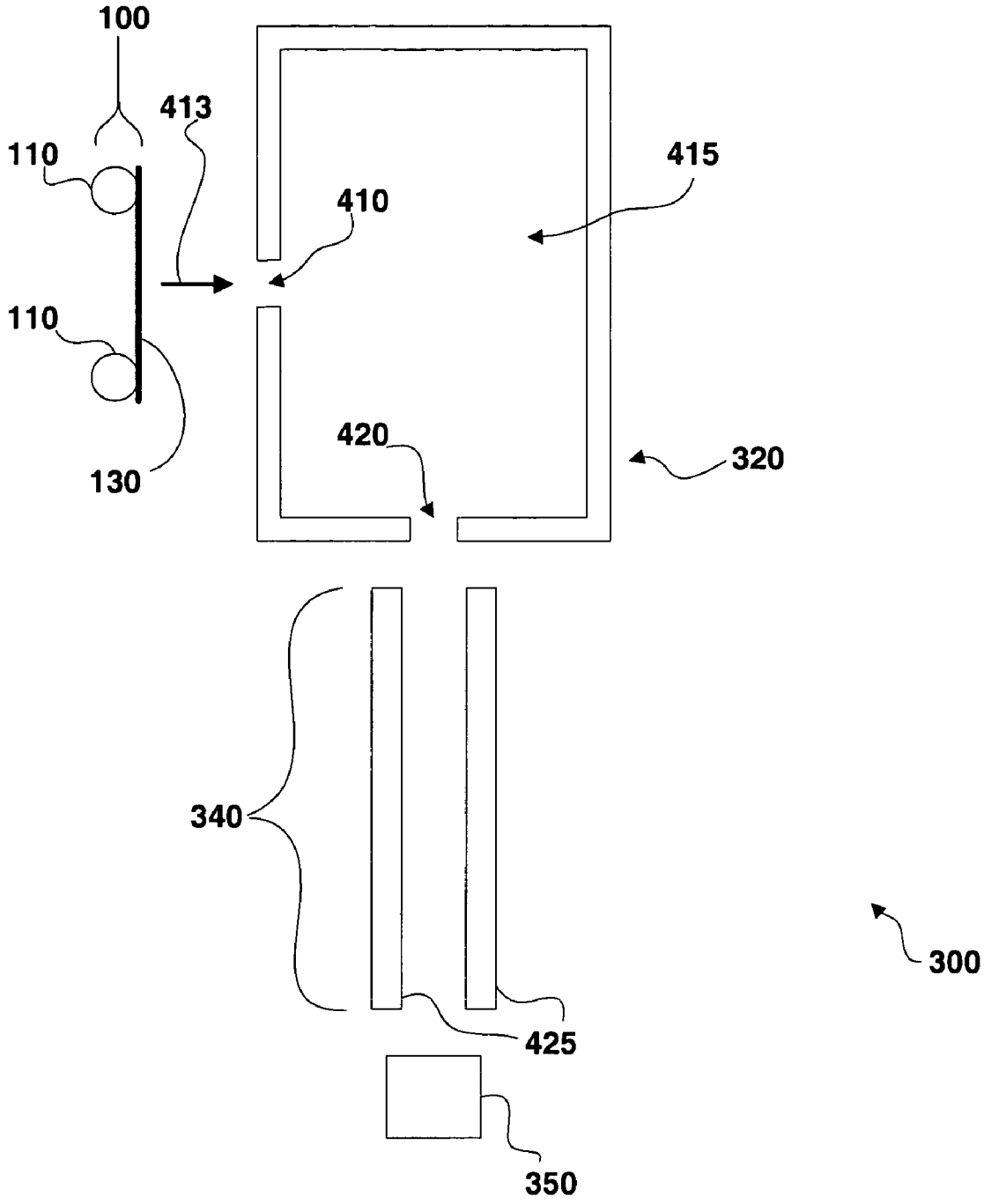
FIG. 4 illustrates an embodiment of an analysis system, according to various embodiments of the invention.

FIG. 4 illustrates an embodiment of analysis system 300. In this embodiment filament assembly 100 is positioned relative to source 320, which includes an opening 410 for electrons 413 to pass from electron filament 130 to the interior 415 of source 320. Ionization occurs within source 320 as a result of interactions between electrons generated at electron filament 130 and molecules and/or atoms within interior 415. Resulting ions pass through an opening 420. In this embodiment, mass filter 340 is a quadrupole device including a plurality of rods 425. Ions of appropriate mass to charge ratio pass through mass filter 340 and reach detector 350. In alternative embodiments mass filter 340 is based on time-of-flight, ion cyclotron resonance, ion drift, octapoles, hexapoles, magnetic or electric fields or other means of separating ions as a function of mass or mass/charge ratio. Mass filter 340 is optionally replaced by a filter responsive to collisional cross-section of ions.

Figure 5:
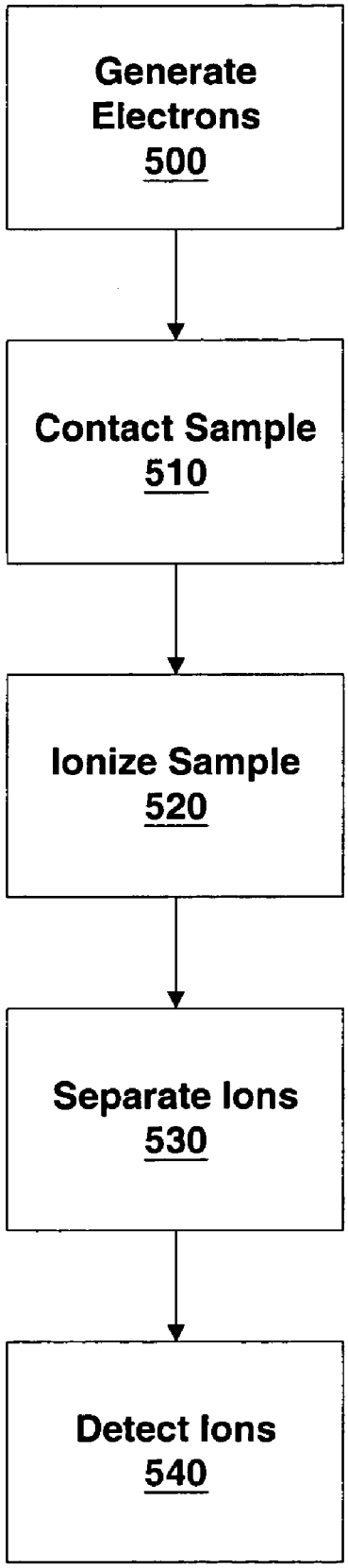
FIG. 5 is a flow diagram illustrating a method according to various embodiments of the invention.

FIG. 5 is a flow diagram illustrating a method according to an embodiment of the invention. In a step 500 electrons 413 are generated at a nanofilament 220 coated electron-filament 130. In a step 510 electrons are brought in contact with sample. This step typically includes use of electric or magnetic fields to guide electrons 413 into source 320. In a step 520 the generated electrons are used to ionize a sample atom or molecule. In one embodiment of step 520, ionization occurs through electron impact, in another embodiment ionization occurs through electron capture and in yet another embodiment chemical ionization occurs. In a step 530, ionized sample is separated. In one embodiment of step 530, separation is responsive to a mass to charge ratio of a sample ion. In alternative embodiments of step 530 separation is based on mass or collision cross-section. In a step 540 the separated ions are detected using detector 350.

Figure 6:
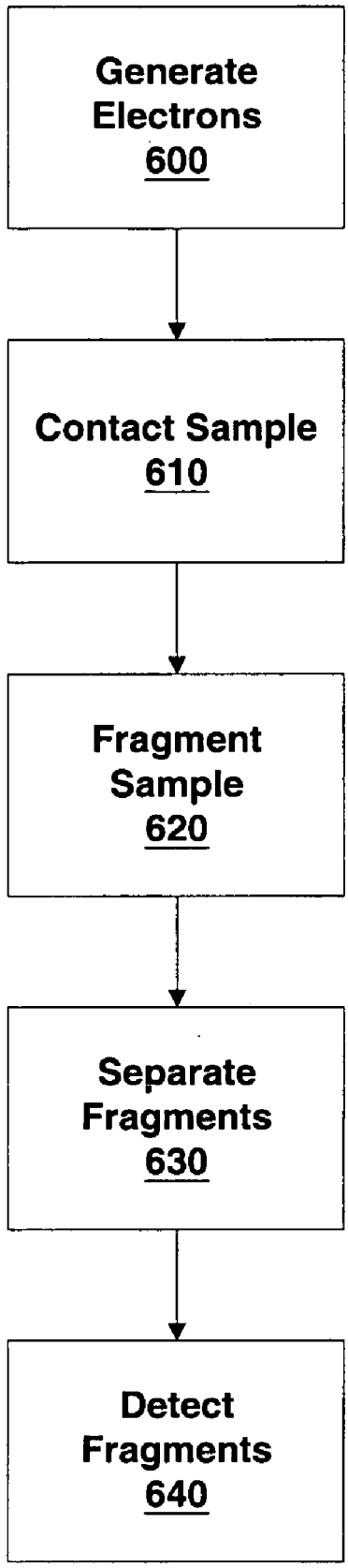
FIG. 6 is a flow diagram illustrating a method according to various embodiments of the invention.

FIG. 6 is a flow diagram illustrating a method according to an embodiment of the invention. In a step 600, electrons are generated at a nanofilament 220 coated electron filament 130. In a step 610, electrons are brought in contact with sample ions. This step typically includes use of electric or magnetic fields to guide electrons into source 320. In a step 620, the sample ions are fragmented by the electrons. In a step 630 fragmented sample ions are separated. In one embodiment of step 630 separation is responsive to a mass to charge ratio of a sample ion. In alternative embodiments of step 630 separation is based on mass, momentum, kinetic energy or collision cross-section. In a step 640, the fragmented separated ions are detected using detector 350.

Figure 7:
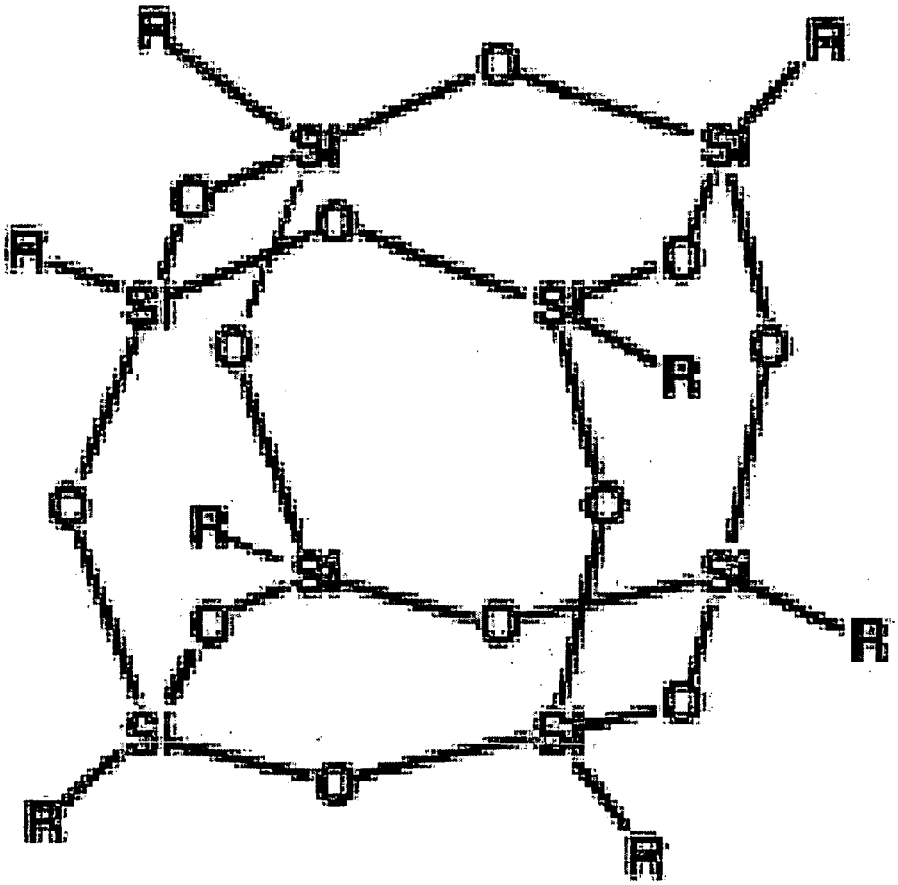
FIG. 7 illustrates an example of a polyhedral oligomeric silsesquioxane nanoparticle.

In various alternative embodiments of the invention electron filament 130 includes a plurality of nanoparticles disposed within the electron filament 130. In these embodiments, nanofilaments 220 are optional. The nanoparticles are configured to modify grain boundaries within electron filament 130. For example, in one embodiment the nanoparticles reduce growth of grain boundaries during temperature changes. In one embodiment the nanoparticles are configured to reduce thermal movement of electron filament 130. In some embodiments the nanoparticles include polyhedral oligomeric silsesquioxane or similar silicon containing compound. FIG. 7 illustrates an example of a polyhedral oligomeric silsesquioxane include in these nanoparticles, according to one embodiment of the invention. In the embodiments of the invention including a plurality of nanoparticles, the filament assembly may be used in applications other than mass analysis. For example filament assembly 100 may be included in an electron gun, an x-ray source, an electron etching system, or the like.

Several embodiments are specifically illustrated and/or described herein. However, it will be appreciated that modifications and variations are covered by the above teachings and within the scope of the appended claims without departing from the spirit and intended scope thereof.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A mass analyzer comprising an electron source, the electron source including:

an electron filament coupled to an electrical supply, the electron filament including a conductive wire or conductive ribbon, the electron filament configured to generate electrons when heated and configured to generate electrons while a background pressure in the source is greater than $1.0\times10^{-5}$ Torr;

a plurality of nanofilaments disposed on the surface of the electron filament; and a filament body for positioning the electron filament relative to a mass filter.

2. The mass analyzer of claim 1, wherein the electron filament is configured to generate electrons when heated in an electric field of less then 70 volts per centimeter.

3. The mass analyzer of claim 1, wherein the electron filament is configured to generate electrons when heated in an electric field of less then 50 volts per centimeter.

4. The mass analyzer of claim 1, wherein the electron filament is configured to generate electrons while a background pressure in the source is greater than $1.0\times10^{-4}$ Torr.

5. A mass analyzer comprising an electron source, the electron source including:

an electron filament coupled to an electrical supply configured to pass a current through the electron filament;

a plurality of nanofilaments disposed on the surface of the electron filament;

a filament body for positioning the electron filament relative to a mass filter; and a magnetic field configured for directing electrons generated using the electron filament.

6. The mass analyzer of claim 5, wherein the nanofilaments include carbon nanotubes.

7. The mass analyze of claim 5, wherein the electron source is configured to generate electrons for electron capture ionization.

8. The mass analyzer of claim 5, wherein the electron source is configured to generate electrons for chemical ionization.

9. The mass analyzer of claim 5, wherein the electron source is configured to generate electrons for ion fragmentation.

10. The mass analyzer of claim 5, further including a mass filter.

11. The mass analyzer of claim 5, wherein the electron source is configured to generate electrons for electron impact ionization.

12. A mass analyzer comprising an electron source, the electron source including:

an electron filament coupled to an electrical supply configured to pass a current through the electron filament;

a plurality of nanofilaments disposed on the surface of the electron filament;

a filament body for positioning the electron filament relative to a mass filter; and means for directing electrons generated using the electron filament;

wherein the electron source is configured such that the directed electrons are accelerated to an energy of approximately 70 electron volts.

13. The mass analyzer of claim 12 wherein the nanofilaments include boron.

14. The mass analyzer of claim 12, wherein the electron source is configured to generate electrons for electron impact ionization.

15. The mass analyzer of claim 12, wherein the electron filament is a ribbon or wire.

16. The mass analyzer of claim 12, further including a sample source.

17. The mass analyzer of claim 12, further including a mass filter.

18. The mass analyzer of claim 12, wherein the nanofilaments include carbon nanotubes.

19. A filament assembly comprising:

an electron filament coupled to an electrical supply configured to provide a current through the electron filament and to hold the electron filament at a potential of approximately 70 Volts relative to part of an electron source;

a plurality of nanofilaments disposed on the surface of the electron filament; and means for positioning the electron filament.

20. The filament assembly of claim 19, wherein the electron filament is a wire or a ribbon.

21. An analysis system comprising:

an electron filament coupled to an electrical supply configured to pass a current through the electron filament and to hold the electron filament at a potential of approximately 70 Volts relative to an other part of the analysis system, the electron filament including a conductive wire or conductive ribbon, the electron filament configured to generate electrons when heated;

a plurality of nanofilaments disposed on the surface of the electron filament;

a filament body for positioning the electron filament relative to the other part of the analysis system;

means for directing electrons generated using the electron filament;

a mass filter configured to filter ions generated using the generated electrons; and an ion detector configured to detect the filtered ions.

22. The analysis system of claim 21, further including a chromatograph configured to introduce a sample to the mass filter.

23. The analysis system of claim 21, further including a second mass filter configured to introduce a sample to the mass filter configured to filter ions generated using the generated electrons.

24. A method of analyzing a sample comprising:

generating electrons with energy of approximately 70 eV, using an electron filament coupled to an electrical supply configured to pass a current through the electron filament and to hold the electron filament at an approximate potential, the electron filament including a conductive wire or conductive ribbon, the electron filament further including a plurality of nanofilaments disposed on the surface of the electron filament;

causing the generated electrons to contact the sample;

ionizing the sample using the generated electrons, to produce ions;

separating the produced ions; and detecting the separated ions.

25. The method of claim 24, wherein the separated ions are separated in time.

26. The method of claim 24, wherein the produced ions are produced using chemical ionization.

27. The method of claim 24, further including maintaining a background pressure greater than $1\times10^{-5}$ Torr.

28. A method of analyzing a sample comprising:

generating electrons using an electron filament coupled to an electrical supply configured to pass a current through the electron filament and to hold the electron filament at an approximate potential, the electron filament including a conductive wire or conductive ribbon, the electron filament further including a plurality of nanofilaments disposed on the surface of the electron filament;

causing the generated electrons to contact an ion in a region with a background pressure of greater than $1\times10^{-4}$ Torr;

fragmenting the ion using the generated electrons, to produce an ion fragment;

filtering the produced ion fragment; and detecting the filtered ion fragment.

29. The method of claim 28, further including generating the ion using a mass filter.

30. A filament assembly comprising:

an electron filament configured to be coupled to an electrical supply for providing a current through the electron filament and for holding the electron filament at a potential relative to part of an electron source; and a plurality of nanoparticles disposed within the electron filament.

31. The filament assembly of claim 30, wherein the nanoparticles are configured to modify grain boundaries within the electron filament.

32. The filament assembly of claim 30, wherein the nanoparticles include polyhedral oligomeric silsesquioxane.

33. The filament assembly of claim 30, wherein the nanoparticles include a silicon compound of the chemical composition $Si_8O_8R_8$.

34. The filament assembly of claim 30, further including means for positioning the electron filament relative to a mass filter.

35. The filament assembly of claim 30, wherein the potential relative to part of an electron source is approximately 70 Volts.

36. The filament assembly of claim 30, further including means for positioning the electron filament relative to an electron gun.

* * * * *